US012575619B2

(12) United States Patent
Goldschmidt et al.

(10) Patent No.: US 12,575,619 B2
(45) Date of Patent: Mar. 17, 2026

(54) WASHABLE QUICK-DRY PADS FOR USE WITH APPAREL

(71) Applicant: The Haberdash Group, Inc., Valley Stream, NY (US)

(72) Inventors: Ricardo Goldschmidt, Woodmere, NY (US); Joshua Weinberg, Woodmere, NY (US); Elimelech Blumstein, Valley Stream, NY (US); Abby Steiger, Nashville, TN (US)

(73) Assignee: THE HUUG GROUP INC., Valley Stream, NY (US)

( * ) Notice: Subject to any disclaimer, the term of this patent is extended or adjusted under 35 U.S.C. 154(b) by 0 days.

(21) Appl. No.: 18/475,150

(22) Filed: Sep. 26, 2023

(65) Prior Publication Data

US 2024/0032616 A1 Feb. 1, 2024

Related U.S. Application Data

(60) Provisional application No. 63/392,455, filed on Jul. 26, 2022.

(51) Int. Cl.
*A41C 3/14* (2006.01)

(52) U.S. Cl.
CPC ..... *A41C 3/144* (2013.01)

(58) Field of Classification Search
None
See application file for complete search history.

(56) References Cited

U.S. PATENT DOCUMENTS 4,013,750 A * 3/1977 Magidson ..... B29C 51/004 264/134
6,156,406 A * 12/2000 Rock ..... B32B 5/26 428/86
9,828,705 B1 * 11/2017 Shiue ..... D04B 1/12
2003/0220048 A1 11/2003 Toro et al.
(Continued)

FOREIGN PATENT DOCUMENTS

CN 200944855 Y 9/2007

OTHER PUBLICATIONS

Plasticut Engineering Plastic Solutions; "Differences Between Nylon and Acrylic Plastic"; archived by WayBack Machine on Feb. 29, 2020 https://www.plasticut.com.au/differences-nylon-acrylic-plastic/ (Year: 2020).*

(Continued)

*Primary Examiner* — Jocelyn Bravo
(74) *Attorney, Agent, or Firm* — Bochner PLLC; Andrew D Bochner

(57) ABSTRACT

A pad may include a first surface and a second surface, wherein the first surface and the second surface may have a spherical curvature, and wherein the spherical curvature may be complementary to the bra portion. A pad may include a plurality of synthetic fibers disposed between the first surface and the second surface, wherein each of the plurality of synthetic fibers may contact the first surface and the second surface. A pad may include a pad permeability configured as a function of a quantity of the plurality of synthetic fibers and a length of the plurality of synthetic fibers, the pad permeability may be adapted to allow fluid passage of a liquid and prevent retention of said liquid.

9 Claims, 4 Drawing Sheets

(56) References Cited

U.S. PATENT DOCUMENTS

| | | | | |
|---|---|---|---|---|
| 2004/0097151 | A1* | 5/2004 | McMurray | D04B 1/126<br>442/306 |
| 2004/0224603 | A1* | 11/2004 | Kaye | A41C 3/10<br>450/1 |
| 2010/0069869 | A1 | 3/2010 | Johnston | |
| 2011/0287691 | A1* | 11/2011 | Hu | A41C 3/10<br>450/56 |
| 2020/0085113 | A1* | 3/2020 | Rendone | A41C 3/10 |

OTHER PUBLICATIONS

International Search Report and Written Opinion of the International Searching Authority in relation to International Application No. PCT/US2023/033763, dated Jan. 18, 2024, 11 pages.

* cited by examiner

WASHABLE QUICK-DRY PADS FOR USE WITH APPAREL

CROSS-REFERENCE TO RELATED APPLICATIONS

The present application claims the benefit of U.S. Patent Application No. 63/392,455 for WASHABLE QUICK-DRY PADS FOR USE WITH APPAREL, filed Jul. 26, 2022, the entire contents of which is incorporated herein by reference in its entirety.

FIELD OF THE DISCLOSURE

The present disclosure is related generally to the field of apparel. More particularly, the present disclosure relates to apparel and components thereof configured to minimally absorb fluid and quickly expel said fluid.

INTRODUCTION

Traditionally, apparel, such as standard bras, sports bras, and bikinis, are outfitted with a conventional padding. Such conventional padding may be both removable and formed of foam-type fabrics.

Due to the material composition of conventional pads, the host apparel is not washable while the pad is deposited within the apparel without causing damage to the apparel or padding. Further, considering the absorbent nature of conventional padding, water may be retained within the padding, which can cause discomfort and hygiene issues. In particular, a conventional pad's retention of the wearer's sweat may cause both persistent odor and generally unsanitary conditions.

Additionally, conventional paddings may be removable pads adapted for insertion into a small hole on the inside of the bra or bathing suit. The process of depositing the conventional padding within the small hole may be difficult. After positioning the conventional padding within the apparel, maintaining the proper orientation and shape is difficult and may require frequent adjustment. In effect, once removed, the conventional pads become substantially more difficult to place back within the apparel. Moreover, because the conventional pads must be removed during washing, the pads cannot be sewn into their preferred position.

Apparel comprising conventional pads may take up to twenty-four hours to dry, which is inconvenient in bras and, especially, uncomfortable in bathing suits (for example, if being worn after swimming). Such removable pads also tend to get mangled and lose their positioning during use and laundering. Often many apparel pieces are not washable due to inclusion of conventional pads. Such conventional pads are frequently made of a foam that retains water and deforms during washing. As an example, women often experience problems with bathing suits because after exiting a body of water, the main body of the bathing suit may dry quickly (for example, in the sun), but the conventional padded cups retain water. In such an example, the wet pads may stain clothing placed over the bathing suit.

The present apparel and improved padding thereof overcome the foregoing problems and provide apparel with padding configured to withstand laundering and quickly expel water.

SUMMARY

Aspects of the present disclosure relate to a pad for use with a bra portion of an apparel, the pad including: a first surface and a second surface, wherein the first surface and the second surface have a spherical curvature, and wherein the spherical curvature is complementary to the bra portion; a plurality of synthetic fibers disposed between the first surface and the second surface, wherein each of the plurality of synthetic fibers contact the first surface and the second surface; and a pad permeability configured as a function of a quantity of the plurality of synthetic fibers and a length of the plurality of synthetic fibers, the pad permeability adapted to allow fluid passage of a liquid and prevent retention of said liquid.

Aspects of the present disclosure relate to a pad, wherein the pad is configured to permanently affix to the bra portion.

Aspects of the present disclosure relate to a pad, wherein the pad is configured to removably nest within the bra portion.

Aspects of the present disclosure relate to a pad, wherein each of the plurality of synthetic fibers has a length in a range of 1-10 mm.

Aspects of the present disclosure relate to a pad, wherein the plurality of synthetic fibers are constructed from 100% polyester.

Aspects of the present disclosure relate to a pad, wherein the plurality of synthetic fibers are constructed from a plurality of synthetic materials.

Aspects of the present disclosure relate to a pad, wherein the plurality of synthetic fibers are constructed from nylon and polyester.

Aspects of the present disclosure relate to a method for manufacturing a pad for use with a bra portion of an apparel, the method including: placing a flat section of a spacer fabric into a mold, wherein the spacer fabric includes a first surface, a second surface, and a plurality of synthetic fibers; pressing the spacer fabric, via a preformed tool, into a receiving portion of the mold; applying heat, via a molding machine and the mold, to the spacer fabric; and forming the first surface and the second surface of the spacer fabric to a desired form Aspects of the present disclosure relate to a method, wherein the first surface and the second surface have a spherical curvature.

Aspects of the present disclosure relate to a method, wherein the spherical curvature is complementary to the bra portion.

Aspects of the present disclosure relate to a method, wherein the plurality of synthetic fibers are disposed between the first surface and the second surface, and wherein each of the plurality of synthetic fibers contact the first surface and the second surface.

Aspects of the present disclosure relate to a method, wherein the pad includes a pad permeability configured as a function of a quantity of the plurality of synthetic fibers and a length of the plurality of synthetic fibers, the pad permeability adapted to allow fluid passage of a liquid and prevent retention of said liquid.

Additional aspects related to this disclosure are set forth, in part, in the description which follows, and, in part, will be obvious from the description, or may be learned by practice of this disclosure.

It is to be understood that both the foregoing and the following descriptions are exemplary and explanatory only and are not intended to limit the claimed disclosure or application thereof in any manner whatsoever.

BRIEF DESCRIPTION OF THE DRAWINGS

The incorporated drawings, which are incorporated in and constitute a part of this specification exemplify the aspects of the present disclosure and, together with the description, explain and illustrate principles of this disclosure.

DETAILED DESCRIPTION

Figure 2:
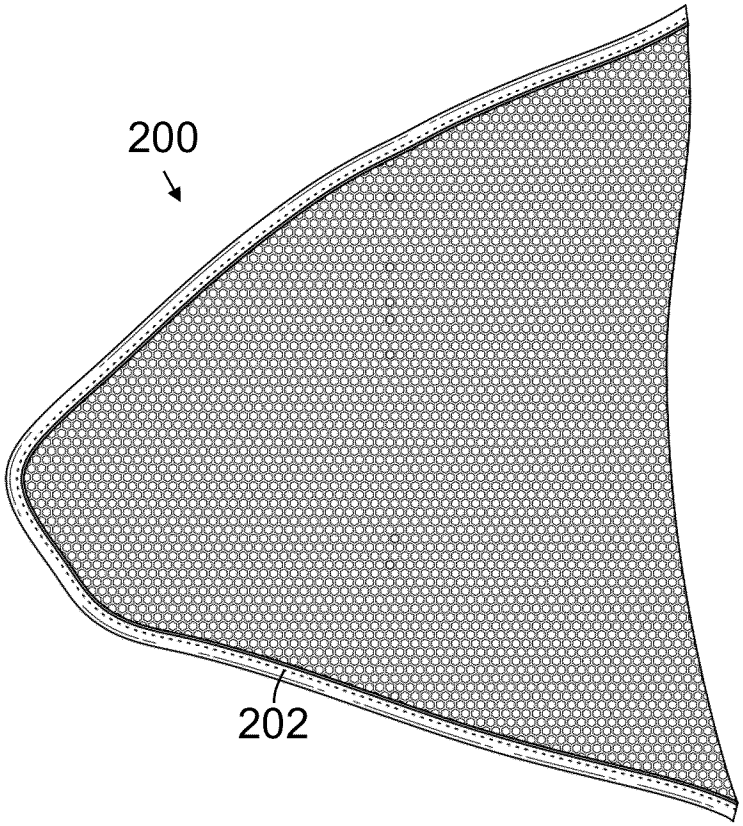
FIG. 2 shows a pad with seams according to aspects of the present disclosure.

In the following detailed description, reference will be made to the accompanying drawing(s), in which identical functional elements are designated with like numerals. The aforementioned accompanying drawings show by way of illustration, and not by way of limitation, specific aspects, and implementations consistent with principles of this disclosure. These implementations are described in sufficient detail to enable those skilled in the art to practice the disclosure and it is to be understood that other implementations may be utilized and that structural changes and/or substitutions of various elements may be made without departing from the scope and spirit of this disclosure. The following detailed description is, therefore, not to be construed in a limited sense.

It is noted that description herein is not intended as an extensive overview, and as such, concepts may be simplified in the interests of clarity and brevity. As used herein, a "set" may refer generally to one or more of the item to which it relates. Thus, items appended with the language of "set" or "one or more" may be interpreted as one or more of the item.

All documents mentioned in this application are hereby incorporated by reference in their entirety. Any process described in this application may be performed in any order and may omit any of the steps in the process. Processes may also be combined with other processes or steps of other processes.

Throughout the specification, wherever practicable, like structures will be identified by like reference numbers. In some figures, components, such as additional electrical connections or fasteners have been omitted for clarity in the drawings. Unless expressly stated otherwise, the term "or" means "either or both" such that "A or B" includes A alone, B alone, and both A and B together.

Although the present device and system has been described in terms of various embodiments, it is to be understood that such disclosure is not intended to be limiting. Various alterations and modifications will be readily apparent to those of skill in the art. Accordingly, it is intended that the appended claims be interpreted as covering all alterations and modifications as fall within the spirit and scope of the invention.

The present disclosure may include an apparel and/or padding 100 thereof configured to expel fluids, such as water, quickly after exposure to said fluid. Similarly, the padding 100 may be adapted to not absorb water or other fluids. The padding 100 of the present disclosure may be molded to fit within various apparel types, such that the padding is not required to be removed during laundering. Further, in an embodiment, as the padding 100 does not require removal, the padding 100 may be fixed in position within the host apparel, such that the padding 100 remains in a preferred orientation. The host apparel may include a bra as discussed herein. However, any suitable host apparel may be utilized such as jackets, pants, shirts, etc.

Figure 1:
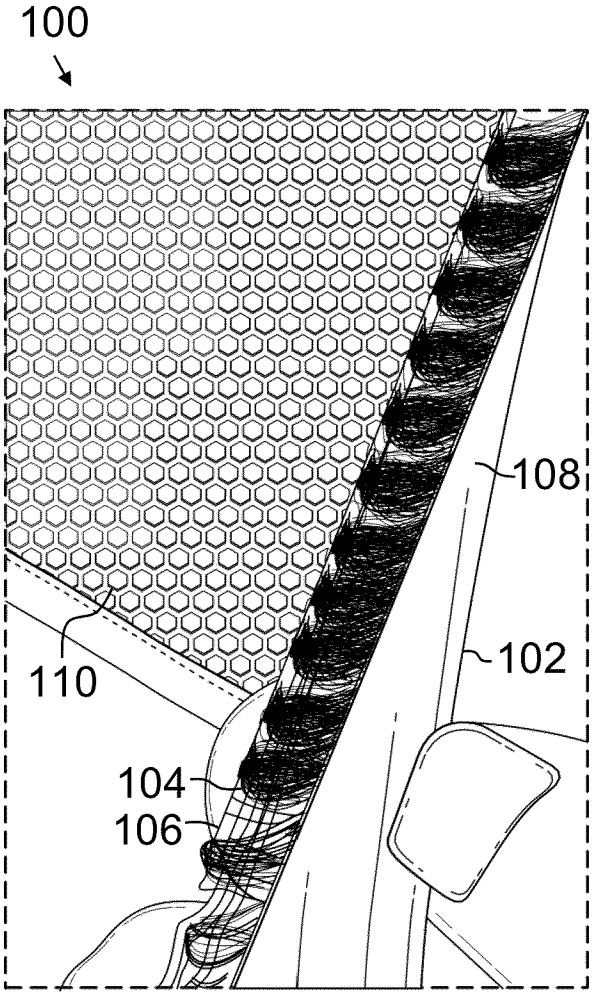
FIG. 1 shows an embodiment of padding according to aspects of the present disclosure.

As exemplified in FIG. 1, the padding 100 may be composed of a spacer fabric 102 (e.g., 3D air spacer mesh fabric). The spacer fabric 102 may be a three-dimensional material (for example, a fabric) comprising a plurality of synthetic fibers 104. Such a fabric 102 may be composed of 100% polyester.

In an embodiment, the spacer fabric 102 may comprise a plurality of materials. For example, the spacer fabric 102 may be composed of alternate synthetic fibers, i.e., nylon or spandex, of combinations thereof. A central material, bound by a first surface 106 and a second surface 108, may also be composed of 100% polyester, or a combination of materials. In one embodiment, the first and second surfaces 106/108 may differ in material makeup. For example, the first surface 106 may be composed of alternate synthetic fibers, i.e., nylon or spandex, of combinations thereof. In an embodiment, the synthetic fibers 104 may traverse the thickness of the spacer fabric 102, for example, maintaining a substantially uniform distance between the first and second surfaces 106/108 of the spacer fabric 102. However, in some embodiments, the thickness of the padding 100 may be non-uniform. As a non-limiting example, padding 100 configured for use in a "push up" bra may be formed with a greater thickness on the bottom portion of the padding 100 to create a lifting effect.

The spacer fabric 102 may promote air circulation through the apparel and/or padding 100 as a function of the plurality of synthetic fibers 104. This effect may also promote the impeding of fluid absorption and rapid drying times. Additionally, the padding 100 may be of a springy and/or supportive nature. In an embodiment, the padding 100 is resistant to shedding due to the containment of synthetic fibers 104 between the first and second surfaces 106/108.

The first and second surface 106/108 may include different textures and/or properties. In an embodiment, the first and second surfaces 106/108 may differ by knitting types (i.e., the top surface may be mesh while the bottom surface may be warp knit). The open mesh surface may be better suited for wicking (i.e., not retaining water). However, the bottom surface may be better suited for holding a desired shape and may contribute to the padding's 100 structure. In some embodiments, the first and/or second surfaces 106/108 may include any suitable materials, textures, and/or properties.

The first surface 106 may define one or more open spaces 110. The one or more open spaces 110 may be disposed throughout the spacer fabric 102 as exemplified in FIG. 1. In an embodiment, the one or more open spaces 110 are configured to increase the flow of air and liquid through the spacer fabric 102, which in turn may increase the spacer fabric 102's breathability and moisture wicking ability. The one or more open spaces 110 may form a hexagonal shape as shown in FIG. 1. However, the one or more open spaces 110 may form any suitable shape, such as pentagons, circles, squares, or other suitable shape or combination thereof.

Figure 3:
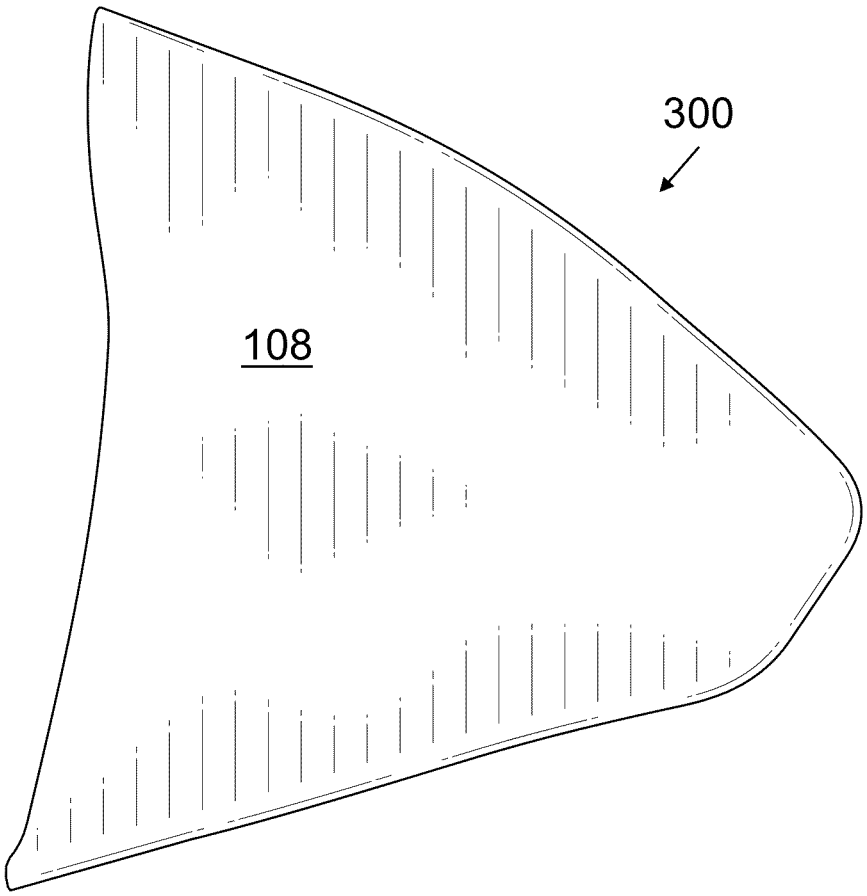
FIG. 3 shows a pad without seams according to aspects of the present disclosure.

In an embodiment, a seam 202 may be disposed circumferentially around the perimeter of the pad 200. However, the pads 300 may also be formed without a seam 202 as show in FIG. 3, wherein the first surface 106, the second surface 108, and plurality of synthetic fibers 104 are continuous or otherwise connected. For example, a bra pad 300 may include edges configured to be substantially flat without a seam 202. Accordingly, such a seamless configuration 300 may provide an aesthetic quality wherein the profile of the bra pad 200 is not apparent through clothing.

The ability of the spacer fabric 102 to be molded, expel liquid, and/or retain shape and positioning is a function of various characteristics of the material. For example, an increase of the quantity of the plurality of synthetic fibers 104 may decrease the material's ability to expel liquid.

Further, an increase in the length of the plurality of synthetic fibers 104 (in effect, an increase in the thickness of the material) may render the mesh fabric as more substantial and rigid, thus decreasing likelihood of deformation. As a non-limiting example, the plurality of synthetic fibers 104 may include a length of 1-10 mm. In an embodiment, the spacer fabric 102 may include a quantity, density, and length of synthetic fibers 104 configured to maximize moldability and promote an enduring preferred shape, while minimizing liquid retention.

In an embodiment, the apparel may include one or more pads 200/300, wherein the one or more pads 200/300 are sized to fit within a specific apparel location. For example, each of the one or more pads 200/300 may be sized to fit within the cup(s) of a bra. Accordingly, the one or more pads 200/300 may include a left pad and a right pad, wherein the left and right pads are geometrically mirrored such that the left and right pad fit the left and right cups, respectively.

The one or more pads 200/300 may include a generally spherical shape, wherein the breast can be sufficiently supported. For example, the one or more pads 200/300 may include spherical curvature and a generally oval, oblong, and/or triangular footprint, enabling the front and/or bottom of the breast to be support without compromising the aesthetic quality of the host garment.

Therefore, the one or more pads 200/300 may be derived from a larger portion of material, wherein the larger portion of material is cut and molded to the preferred geometry.

Figure 4:
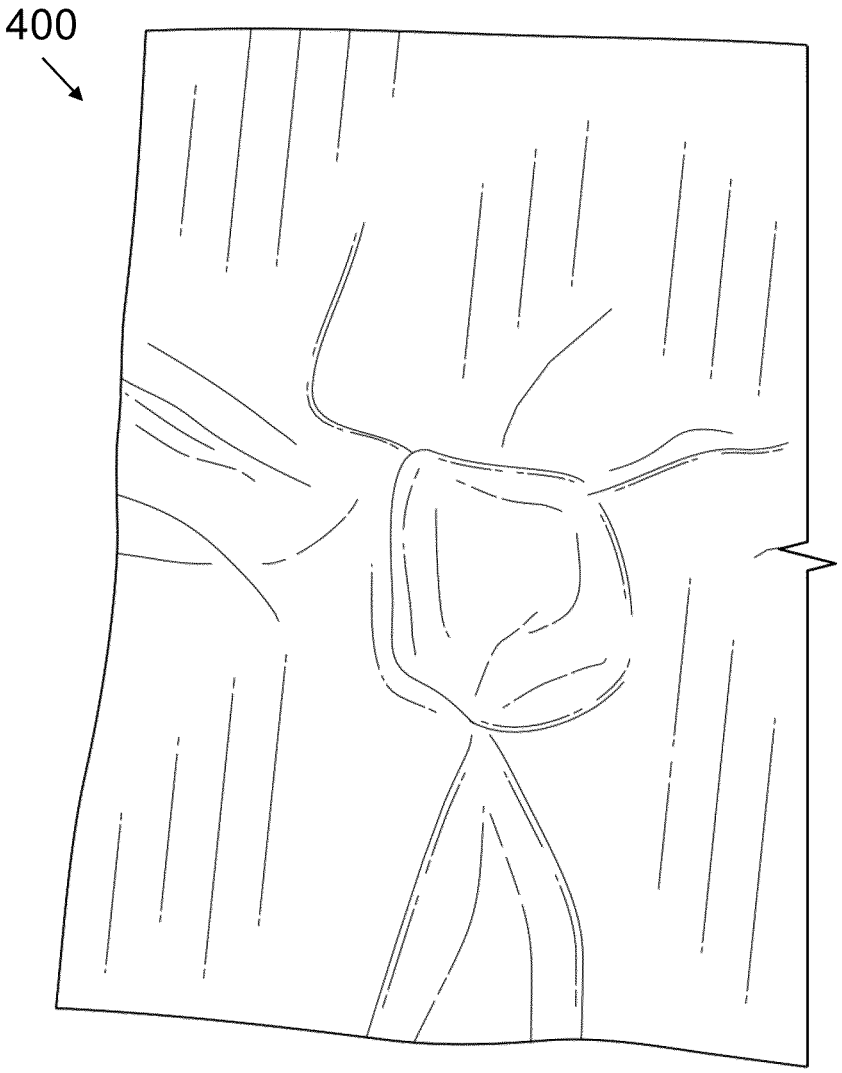
FIG. 4 shows a flat section of spacer fabric according to aspects of the present disclosure.
Figure 5:
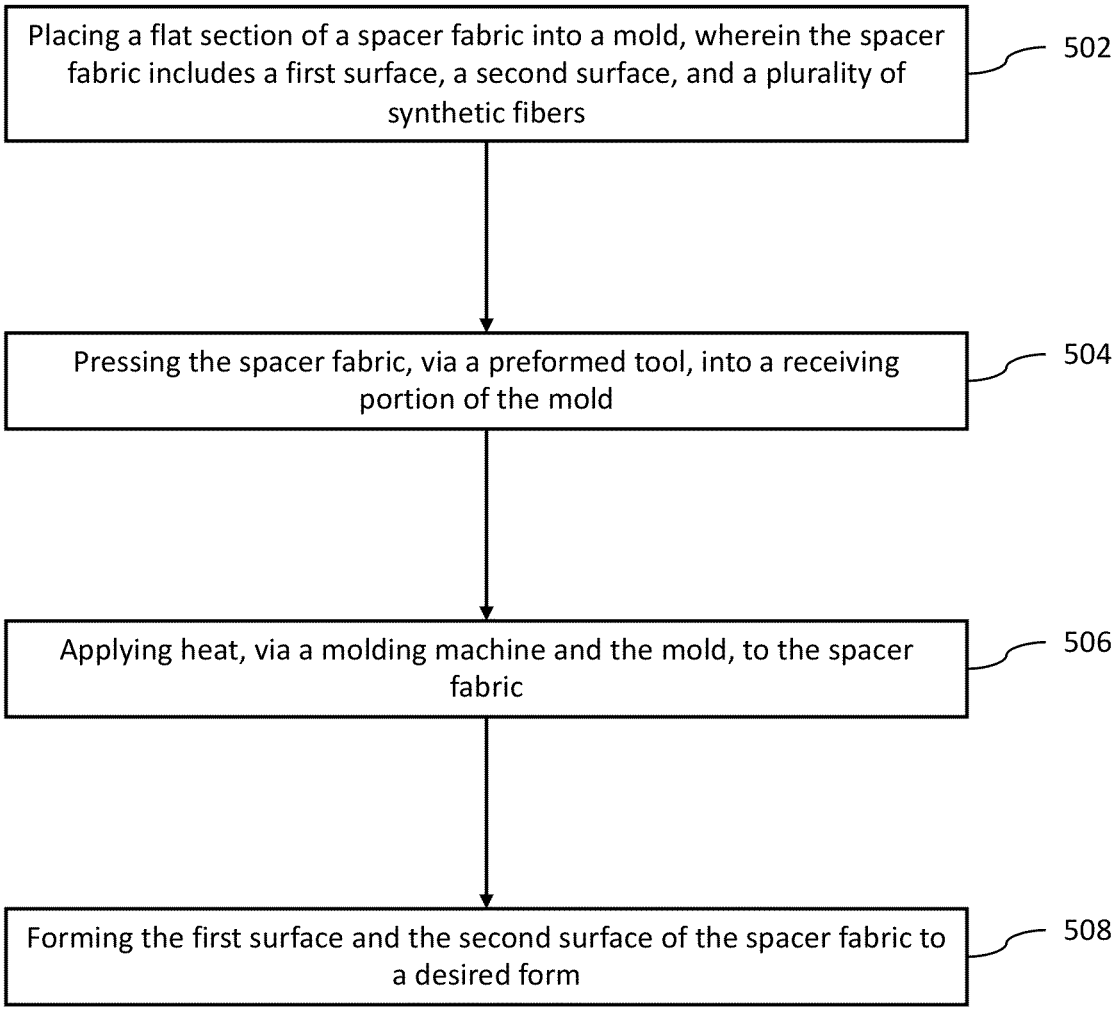
FIG. 5 shows a method for manufacturing pads according to aspects of the present disclosure.

The molding process may first comprise placing a flat section 400 of spacer fabric 102, as shown in FIG. 4, into a mold. The spacer fabric 102 may be selected with an appropriate quantity of synthetic fibers 104 and thickness as will manifest in a desired shape and size. The mold may be sized and configured reciprocal to the preferred geometry of the one or more pads 200/300. In effect, the mold may be utilized to adapt the spacer fabric 102 into pads 200/300 of desired spherical depth and shape. In an embodiment, the molding process may utilize a molding machine, wherein the molding machine includes automation and controllable heat and pressure settings. Thus, the settings of such a machine may be adjusted in conjunction with the characteristics of the spacer fabric 102 to maintain the integrity of the fabric while still molding it into shape. The molding machine may include a preformed tool, ram, and/or other component sized to press the spacer fabric 102 into the receiving portion of the mold. The limit to the permeability of the material may be a function of the material's ability to retain a desired form after molding.

In an embodiment, the molding process may be tailored to the melting point of the first surface 106, the second surface 108, and/or the synthetic fibers 104 substantiating the spacer fabric 102. Accordingly, in some embodiments, the spacer fabric 102 may have a low melting point, wherein the molding process is modified as to decrease likelihood of melting and deformation from over-application of heat. In an embodiment, the plurality of synthetic fibers 104 have a higher melting point than the first and/or second surfaces 106/108, where the first and second surfaces 106/108 include fabrics adapted to provide form and/or shape. Alternatively, in utilizing a thicker fabric, the plurality of synthetic fibers 104 may require a lower melting point to mold such that there is not an over application of heat to the first and/or second surfaces 106/108.

Heat may be applied to the mold, preformed tool, and/or the fabric as to promote sufficient geometric modification of the material. The quantity of heat delivered may be configured to modify the shape of the overall section of material without jeopardizing the integrity of the synthetic fibers 104 within the material. For example, heat may be applied over the course of a specified duration and at an appropriate quantity as to prevent melting of the internal synthetic fibers 104, first surface 106, and/or second surface 108. In an embodiment, the heat does not exceed a temperature of 480° F.

An exemplary method for manufacturing the pads 200/300 using the steps described above. This non-limiting example includes placing the flat section 400 of a spacer fabric 102 into a mold at step 502, then pressing the spacer fabric 102, via a preformed tool, into a receiving portion of the mold at step 504. As described above, the spacer fabric 102 may then be heated to a temperature configured to bond the first and second surfaces 106/108 of the spacer fabric 102 to the plurality of synthetic fibers 104 at step 506. At step 508, the first and second surfaces 106/108 may then be formed to create a desired form of the spacer fabric 102.

There exist a number of supplemental methods that may be utilized to best mold the material and/or apply heat to such material. For example, an additional layer of material, such as thin bonding, may be applied to the outside of the main portion of the padding 100. In one embodiment, a second layer of spacer fabric 102 may be utilized. Accordingly, the additional layer may experience some degree of deformation or melting, however, the internal original layer of material may remain unaffected.

Alternatively, the spacer fabric 102 may be made more heat resistant. For example, the material may be made more heat resistant by modifying the composition of the synthetic fibers, first surface 106, and/or second surface 108. In a further embodiment, the thickness and/or length of the synthetic fibers 104 may be adjusted as to become more heat resistant. For example, material of a greater thickness may be more resistant to incident heat. In an embodiment, the material may be prepared such that it is sufficiently permeable and "airy," and a bonding agent may be applied to said material once shaped to the desired geometry. Thus, a quick-bonding coating may create a thin layer that promotes the continuance of the pad's 200/300 form without adding weight or compromising the pad's 200/300 permeability. Further, the bonding agent may have quick-dry properties, thus not limiting the quick-dry effects of the spacer fabric 102.

In a further embodiment, the spacer fabric 102 may be knit such that the resulting fabric is already spherical in shape. For example, as opposed to creating a flat fabric section, the fabric may be manufactured with a predetermined curvature. Accordingly, such preformed curved material may be cut to the preferred dimensions and inserted into the host garment.

In yet a further embodiment, the one or more pads 200/300 may be manufactured utilizing additive printing (for example, via a "3D Printer"). In such an embodiment, the one or more pads 200/300 may be printed to the desired size, thus not requiring molding of the material. In one embodiment, the material may be manufactured via additive printing in conjunction with heat-activated foaming agents. For example, the material may be printed via photopolymer resin, wherein such a printed resin expands by a predetermined factor once exposed to a particular heat. Therefore, the pad 200/300, after printing and heating, may be composed of the resulting closed cell foam.

In another embodiment, the one or more pads 200/300 may each be formed by a combination of a plurality of fabric sections. For example, a sheet of spacer fabric 102 may be cut into four triangular sections. In such an example, each of the four triangular sections may be sewn together as to form a pad with a spherical curvature. Thus, the one or more pads 200/300 formed by a plurality of fabric sections may include the desired spherical curvature (for example, to provide breast support) without requiring application of heat or other molding procedures. In one embodiment, the seam 202 may be disposed on the inside surface of the pad 200/300 such that the seam is not visible to a third-party. Further, the seam 202 may be shallow or otherwise nonobtrusive as to not cause discomfort to the wearer.

The one or more pads 200/300 may be configured for use as fixed pads (for example, built into apparel such as bras and bathing suits) or as removeable pads (for example, bras and bathing suits configured to allow insertion and removal of pads). In effect, the utilization of removable pads may allow conventional removable pads to be replaced with improved removable pads 200/300, allowing the wearer to indefinitely leave the improved pads 200/300 within the apparel during wear, use, and laundering.

The pads 200/300 and apparel described herein may promote a more positive experience for all wearers of such bras and bathing suits. The one or more pads 200/300, as described herein, may enable laundering of apparel that otherwise would have required pad separation. In an embodiment, the one or more pads 200/300 promote positive hygiene due to the quick-dry nature of the pads 200/300. Accordingly, the one or more improved pads 200/300 and the host apparel may be machine washable. While conventional pads may require twenty-four hours to sufficiently dry, the improved pads 200/300 described herein may dry within one to two hours.

The one or more pads 200/300 may be configured for use with various types of apparel, including but not limited to, bras, sports bras, bathing suits, dresses, tennis dresses, workout dresses, shirts (for example, tee shirts and tank tops), shapewear, and sleepwear. As a non-limiting example, the one or more pads 200/300 may be utilized in conjunction with any apparel having an integrated or "built in" bra. The one or more pads 200/300 may be sewn, placed, or otherwise disposed into apparel upon manufacture, for example, in instances where the pad 200/300 is configured to be fixed or non-removeable. Often, in conventional bras, the pad 200/300 may be undersized as to enable removal. However, an improved pad 200/300, as described herein, may be appropriately sized to provide sufficient support without jeopardizing the removability because, in such an embodiment, the improved pad 200/300 may remain within the apparel indefinitely.

Alternatively, the apparel may be configured to removably accept the improved pads 200/300. In such an embodiment, the apparel may include one or more small holes enabling access to the inside pocket of a bra cup. The pads 200/300 may be sized relative to the one or more small holes and may be flexible and have sufficient plasticity as to enable a user to deposit the pad 200/300 within the cup such that the pad 200/300 returns to its form after passing through the one or more small holes. Accordingly, conventional pads may be removed from conventional bras and be replaced with the improved pads 200/300 described herein.

For the purposes of this disclosure a "bra portion" may refer to any portion of apparel configured to support or accept one or more breasts. In further embodiments, the pads 200/300 disclosed herein may be utilized in any type of apparel and in any portion of said apparel. Thus, the improved pads 200/300 described herein are not limited to use in any particular apparel or portion thereof.

It will be further understood that various changes in the details, materials, and arrangements of the parts that have been described and illustrated herein may be made by those skilled in the art without departing from the scope of the following claims.

While this invention has been described in conjunction with the embodiments outlined above, many alternatives, modifications and variations will be apparent to those skilled in the art upon reading the foregoing disclosure. Accordingly, the embodiments of the invention, as set forth above, are intended to be illustrative, not limiting. Various changes may be made without departing from the spirit and scope of the invention.

What is claimed is:

1. A pad for use with a bra portion of an apparel, the pad comprising:

a first surface having a first texture defined by a plurality of open spaces;

a second surface having a second texture connected to the first surface via a seam disposed circumferentially around a perimeter of the second surface, wherein the first surface and the second surface have a spherical curvature configured to interface with the bra portion, wherein the second texture is comprised of a warp knit, wherein the first surface and the second surface are coated in a bonding agent having quick-dry properties, and wherein the pad is machine washable;

a plurality of synthetic fibers disposed between the first surface and the second surface, the plurality of synthetic fibers comprising:

a fiber length, wherein the fiber length and the plurality of open spaces allow fluid passage of a liquid and prevent retention of said liquid, the plurality of synthetic fibers having a melting point higher than melting points of fibers forming the first surface and the second surface;

a pad thickness defined by the fiber length; and a bottom portion of the pad having a greater pad thickness than an upper portion of the pad.

2. The pad of claim 1, wherein the pad is configured to be permanently affixed to the bra portion.

3. The pad of claim 1, wherein the pad is configured to removably nest within the bra portion.

4. The pad of claim 1, wherein each of the plurality of synthetic fibers has a length in a range of 1-10 mm.

5. The pad of claim 1, wherein the plurality of synthetic fibers are constructed from 100% polyester.

6. The pad of claim 1, wherein the plurality of synthetic fibers are constructed from a plurality of synthetic materials.

7. The pad of claim 6, wherein the plurality of synthetic fibers are constructed from nylon and polyester.

8. A method for manufacturing the pad of claim 1, the method comprising:

placing a flat section of a spacer fabric into a mold, wherein the spacer fabric includes the first surface, the second surface, and the plurality of synthetic fibers;

pressing the spacer fabric, via a preformed tool, into a receiving portion of the mold;

applying heat, via a molding machine and the mold, to the spacer fabric; and forming the first surface and the second surface of the spacer fabric to a desired form.

9. The method of claim 8, wherein each of the plurality of synthetic fibers contact the first surface and the second surface.

* * * * *